United States Patent [19]

Warner

[11] Patent Number: 4,541,826

[45] Date of Patent: Sep. 17, 1985

[54] METHOD AND APPARATUS FOR MAKING COMPOSITE FILTER RODS

[75] Inventor: Brian H. Warner, High Wycombe, United Kingdom

[73] Assignee: Molins PLC, London, England

[21] Appl. No.: 421,834

[22] Filed: Sep. 23, 1982

[30] Foreign Application Priority Data

Sep. 25, 1981 [GB] United Kingdom ..... 8129113

[51] Int. Cl.[4] ..... A24C 5/50

[52] U.S. Cl. ..... 493/48; 493/47

[58] Field of Search ..... 131/84 C; 493/48, 47, 493/39, 44

[56] References Cited

U.S. PATENT DOCUMENTS

| | | | |
|---|---|---|---|
| 3,482,488 | 12/1969 | Sexstone | 493/48 X |
| 3,610,112 | 10/1971 | Labbe | 493/48 X |
| 3,623,404 | 11/1971 | Jackson | 493/48 X |
| 4,285,678 | 8/1981 | Molins | 493/48 |

FOREIGN PATENT DOCUMENTS

| | | |
|---|---|---|
| 971491 | 9/1964 | United Kingdom . |
| 1544116 | 4/1979 | United Kingdom . |

*Primary Examiner*—James F. Coan

*Attorney, Agent, or Firm*—Antonelli, Terry & Wands

[57] ABSTRACT

Composite filters for attachment to cigarettes and containing particulate filtering material are produced by directly accelerating the particulate material, e.g. by means of a rotary impeller (62), to form a continuous stream which converges with a stream of spaced filter portions (6), both streams having approximately the same speed. The stream of particulate material is slightly laterally offset relative to the stream of filter portions, so that particulate material introduced into the spaces between filter portions has a tangential component and follows a helical motion within the space. Excess particulate material is removed by suction assisted scrapers or brushes (80–90). Delivery of particulate material may be regulated by an adjustable screen (65) or by varying the speed of the impeller (62).

26 Claims, 17 Drawing Figures

METHOD AND APPARATUS FOR MAKING COMPOSITE FILTER RODS

Figure 1:
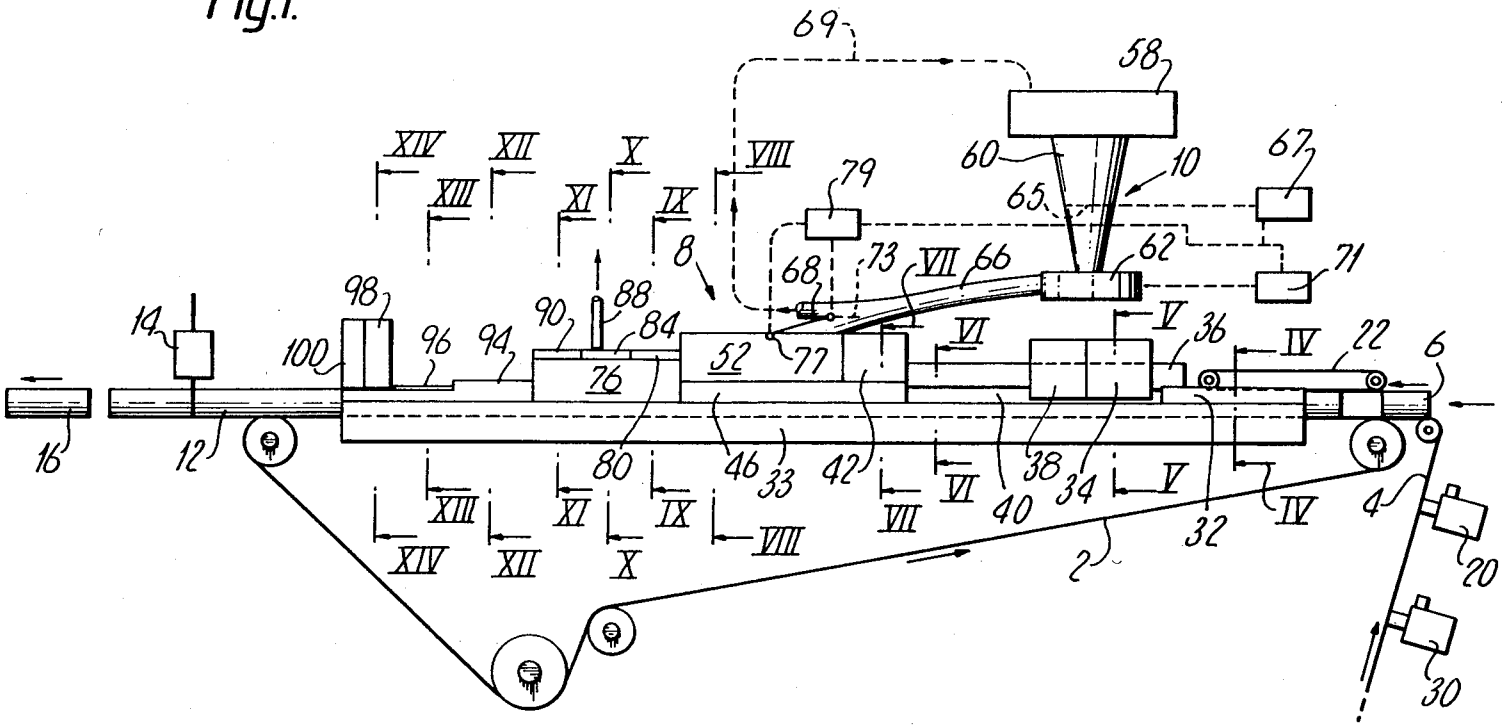

This invention relates to a method and apparatus for making composite filter rod, for producing composite filters for attachment to cigarettes.

It is known to produce composite filter rod which incorporates a granular, powdered or other particulate filter material. One such material commonly used is granulated carbon. In composite filters produced from such a rod the particulate material is usually contained in a compartment between filter portions of conventional filter material (e.g. cellulose acetate). Manufacturers of filters including such compartments require a predetermined quantity of material to be present in each compartment. A common requirement is that the particulate material should be packed into the space between the portions in such a way that smoke drawn through the filter has to pass in close proximity to the material; the compartment should therefore be well filled with the particulate material.

According to one aspect of the present invention a method of producing composite filter rod comprises conveying a stream of spaced component filter portions to an endwise direction, partially wrapping the portions in a continuous wrapper, and conveying a substantially continuous stream of particulate filter material along a path which converges with that of said stream of filter portions, so that the spaces between said portions and enclosed by said wrapper receive particulate material directly from said path.

Preferably said path of the particulate filter material is inclined at a small angle to the path of said filter portions. Preferably the particulate material has a component velocity in the direction of movement of the filter portions which is substantially the same as that of the filter portions.

Particulate material may be introduced into each space in a direction having a significant circumferential component so that a rotary motion is imparted within the space by the surrounding wrapper. Air may be withdrawn from the space during or before filling to aid filling with particulate material. Preferably several spaces between component portions are filled simultaneously.

The rate of supply of particulate filter material along said path may be regulated so that it is sufficient just to fill the spaces between the stream of filter portions passing the filling position. Sensor means may be provided to detect the flow on said path (e.g. to detect any accumulation) and the flow may be regulated accordingly. The stream may be regulated by diverting particulate material onto a subsidiary path, e.g. by directing a variable proportion of a circulating stream onto said converging path. The path of the circulating stream preferably includes a source of particulate material and means for conveying it from the source and around said path.

According to another aspect of the invention apparatus for producing composite filter rod comprises means for conveying a stream of spaced component filter portions in an endwise direction, means for partially wrapping the stream in a continuous wrapper, and means for conveying particulate filter material in a substantially continuous stream on a path which converges towards the stream of partially enclosed filter portions on the wrapper, so that particulate filter material is introduced from said path onto said wrapper between said portions.

The means for conveying the stream of particulate filter material preferably comprises means for imparting velocity directly to the material. Such means may, for example, comprise a rotor or other rotary impeller having outwardly-extending vanes to which particulate filter material is supplied from a source and from which the accelerated material is conveyed along said converging path defined by ducting or the like. Pneumatic means could be used to convey the particulate material but it is preferable to limit the quantity of air delivered with the material unless adequate means is provided for removing air from the filling location. Such means could comprise withdrawing air through the wrapper, through the openings defined by the partial wrapping of the spaces between portions, or through the adjacent filter portions, as well as along a separate path terminating adjacent the filling locations.

Particulate material is preferably introduced at a filling head which extends along the path of the spaced filter portions such that several spaces between portions may be filled simultaneously. The end of the converging path for particulate material, within the filling head, preferably terminates slightly to one side of the centre line of the path of the filter portions, such that a rotary (preferably spiral or helical) movement is imparted to material introduced into the spaces between portions. The filling head may also be shaped adjacent the end of the path to modify the flow path within the spaces between portions. By imparting a rotary movement to introduced particulate material the tendency of material to rebound out of the spaces between portions is diminished; the turbulence produced within the spaces tends to reduce the energy of the material within the spaces.

Means, such as scrapers or brushes, may be provided to shape the upper part of the introduced particulate material and to remove excess from the filter portions and wrapper. Suction may be provided to remove any accumulation of particulate material from the scrapers or brushes. A moving screen, synchronised with the movement of the filter portions, could be provided, having apertures corresponding to the spaces between filter portions and through which apertures the particulate filter material is introduced into the spaces. The blank parts of the screen, covering the filter portions, prevent material being deposited on the portions and thus may avoid the need for means for removing excess particulate material.

Means may be provided for regulating the flow of particulate material on or onto said path. The regulating means may comprise means for varying the flow of particulate material between a supply of said material and the means for conveying material on said path. The regulating means may include means for diverting material from said path, e.g. onto a recirculating path. Control means for the regulating means may include means for sensing flow on said path. The regulating means may be controlled in accordance with the speed of the stream of filter portions, e.g. the means for conveying the particulate material on said path may be driven at a speed proportional to that of a main drive for said apparatus.

Figure 2:
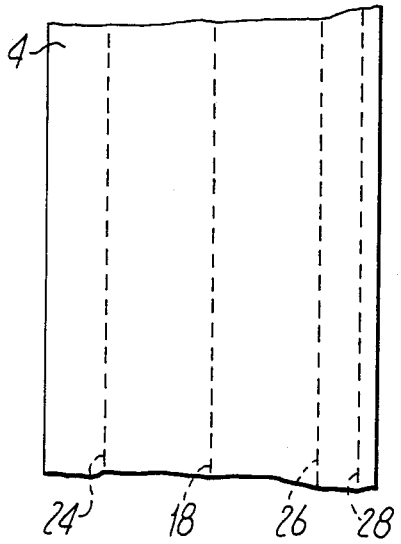
Figure 3:
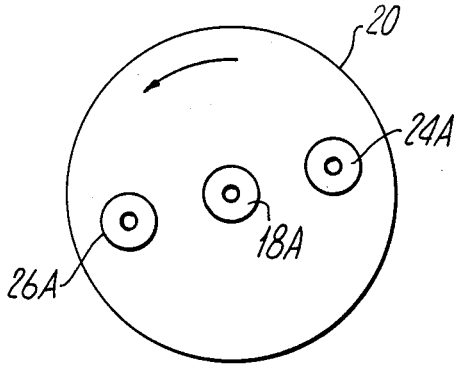
Figure 13:
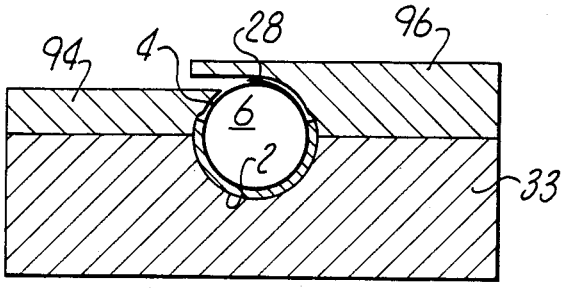
Figure 14:
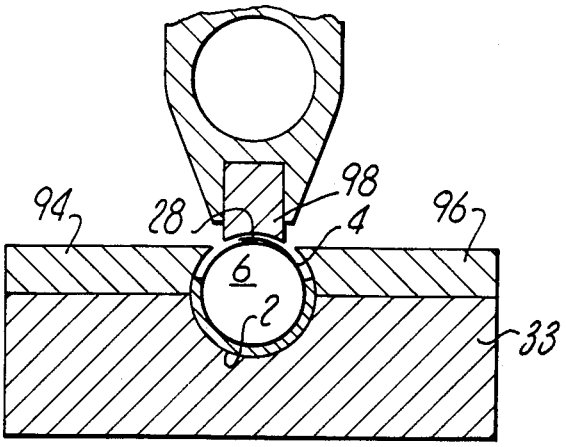
Figure 15:
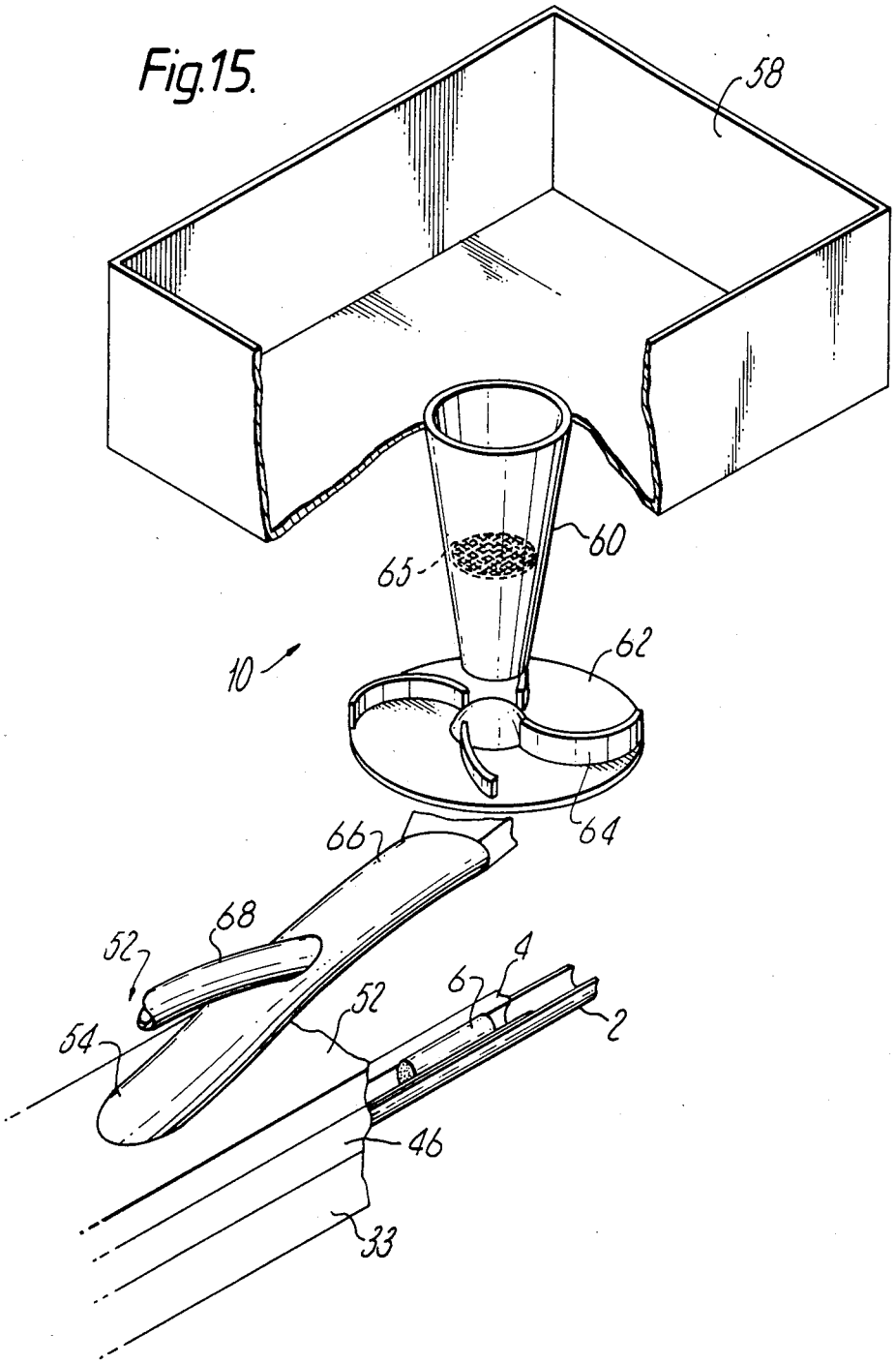
Figure 16:
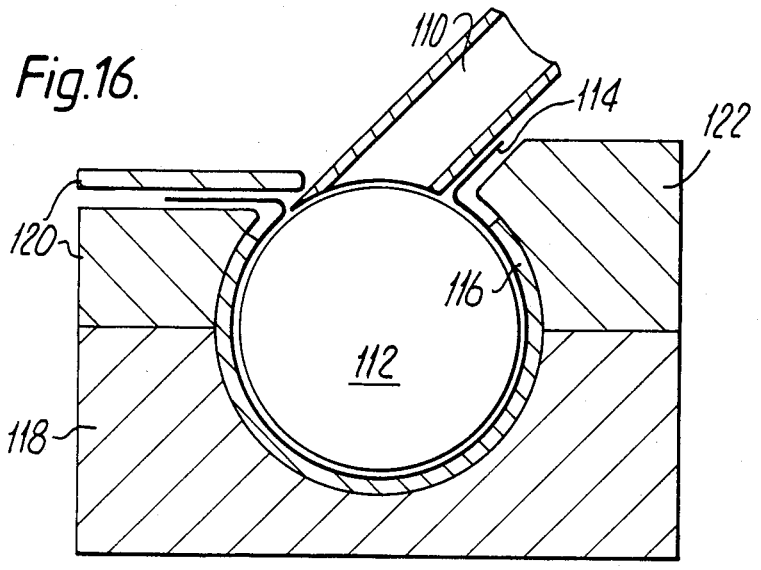
Figure 17:
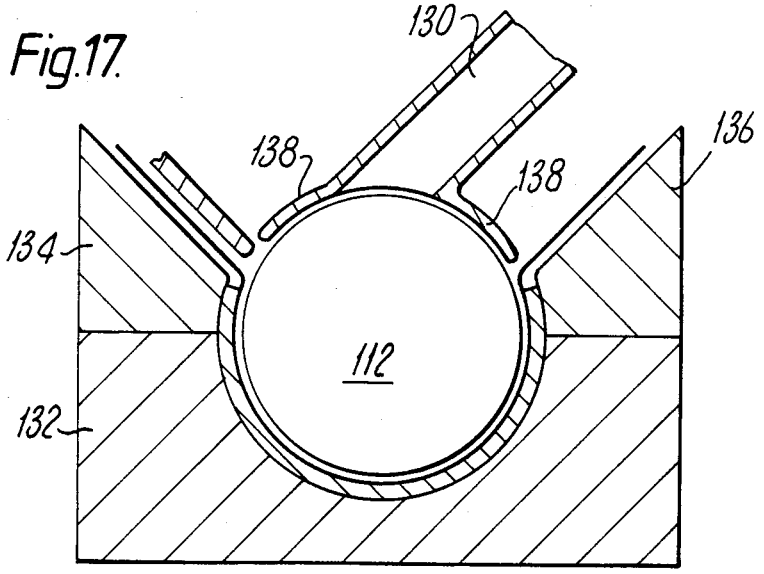

The invention will be further described, by way of example only, with reference to the accompanying diagrammatic drawings, in which:

FIG. 1 is a side view of part of a machine for making filters containing carbon granules, FIG. 2 shows the adhesive lines applied to a wrapper for the filters, FIG. 3 shows an applicator for applying adhesive, FIGS. 4–14 are transverse sectional views at positions indicated by the lines IV–XIV in FIG. 1, FIG. 15 is a perspective view of the applicator for carbon granules used in the machine of FIG. 1, and FIGS. 16 and 17 are transverse sectional views of modified machines for making filters containing carbon granules.

FIG. 1 shows part of a continuous rod-making machine having a garniture tape 2 for conveying a continuous paper wrapper 4 and spaced filter portions 6 through a rod-making unit 8 which includes a carbon granule applicator 10 for filling the spaces between portions with carbon granules. At the end of the unit 8 the garniture tape 2 delivers a continuous composite filter rod 12 to a cut-off 14 which severs the rod into separate composite filter rod lengths 16. In a further machine (not shown) the lengths 16 are subsequently subdivided into individual filter lengths (each including carbon granules) which are joined to tobacco lengths to form filter cigarettes.

The stream of spaced filter portions 6 may be fed onto the wrapper 4 in a manner similar to that used on the Molins DR2N machine or as described in British Patent Specification No. 971491. The relative spacing of the filter portions 6 is maintained initially by an adhesive band or line 18 (FIG. 2) which is applied to the wrapper 4 by an adhesive applicator 20. A top control band 22 is provided to press the portions 6 onto the wrapper 4 and adhesive line 18.

As shown in FIG. 2 the wrapper 4 carries further adhesive lines 24, 26 and 28. The lines 24 and 26 are also applied by the applicator 20. The edge line 28 is applied by an applicator 30 (FIG. 1) positioned upstream of the applicator 20. The lateral positions of the applicators 20 and 30 are independently adjustable relative to the wrapper 4. In addition, as shown in FIG. 3, the lines 18, 24 and 26 are respectively applied by nozzles 18A, 24A and 26A of the applicator 20, the nozzles 24A and 26A being rotatable about the axis of nozzle 18A so that the spacing between the adhesive lines 24 and 26 and the line 18 may be varied. The line 18 is located at the centre line of the wrapper 4, which corresponds to the bottom centre line of the filter portions 6. If the top centre line of the eventually formed rod is regarded as 0° and the bottom as 180° (so Z that the line 18 is at 180°) the lines 26 and 24 are at about 60° and 300° respectively. The line 28 is eventually at about 0° in the completed rod and is positioned close to that edge of the wrapper 4 which will form the overlap. The adhesive used in the applicators 20 and 30 is a hot-melt adhesive.

Additional transverse strips of adhesive may be deposited on the wrapper 4 so that when the wrapper is sealed around the filter portions 6 at least one strip of adhesive bonds the wrapper to the filter portion substantially around its entire circumference. Thus the remote possibility of carbon granules migrating between the wrapper and the filter portion, possibly into a smoker's mouth, can be avoided.

Figure 4:
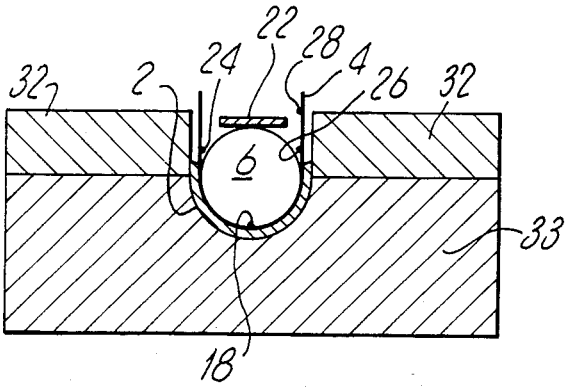
Figure 5:
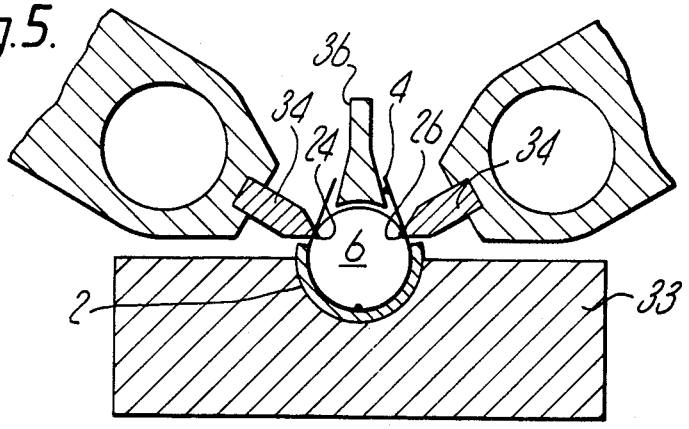

As shown in FIGS. 1 and 4, after receiving the filter portions 6 and wrapper 4 the garniture tape 2 passes through a folding unit 32 mounted on the garniture 33, the unit 32 progressively bending the tape and wrapper into a U-shape. The folding unit 32 continues to bend the tape 2 and wrapper 4 (and subsequently the wrapper alone) beyond the position shown in FIG. 4, until the adhesive lines 24 and 26 touch the filter portions 6. At this stage heating units 34, as shown in FIG. 5, are used to reactivate the hot-melt adhesive of the lines 24 and 26. A central divider 36 maintains separation of the free edges of the wrapper 4. Downstream of the heating units 34 are cooling units 38, substantially similar in construction to the units 34, for setting the adhesive to bond the portions 6 to the wrapper 4 at the lines 24 and 26. The units 38 may be directly connected to the garniture bed 33, so that the latter acts as an additional heat sink. The units 34 may require heat shunts. Possibly appropriate thermally-isolated sections of the garniture bed 33 (or associated folders) may be directly heated or cooled.

Figure 6:
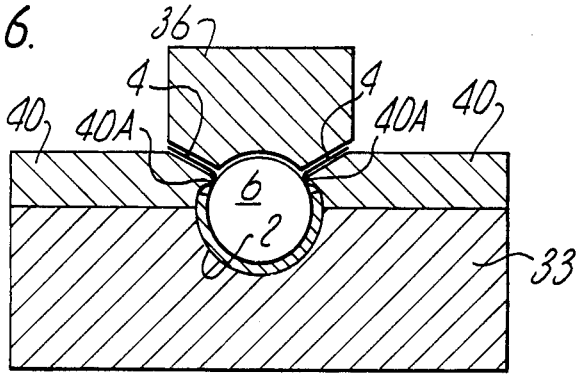

Beyond the cooling units 38 the central divider 36 gradually widens and the shape of side guides 40 for the garniture tape 2 is modified, so that in the position shown in FIG. 6 the free edges of the wrapper 4 are bent outwards while projections 40A of the guides 40 provide an edge around which the wrapper is bent.

Figure 7:
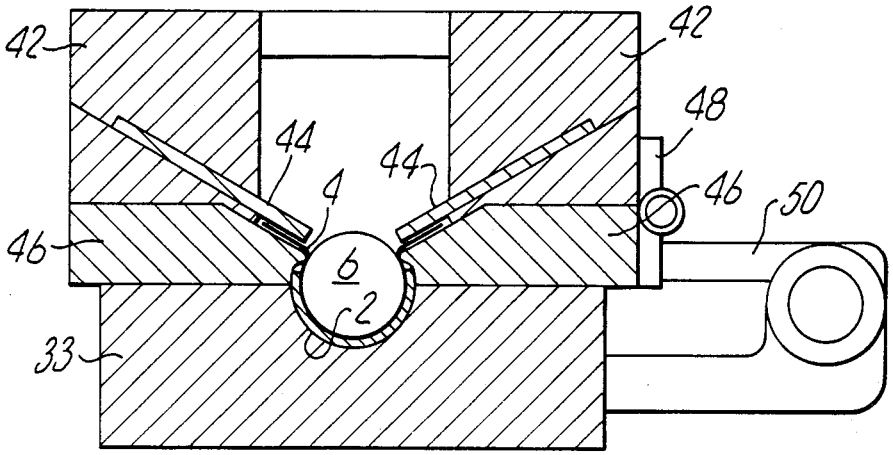

As shown in FIG. 7 an upper guide unit 42, including inclined guide plates 44, takes over from the central divider 36 the function of maintaining the free edges of the wrapper 4 in position. The upper guide unit 42 is connected to a lower guide unit 46 by a hinge 48. The lower guide unit 46 is similar to the guides 40 and is connected to the garniture bed 33 by a hinged connection 50.

Figure 8:
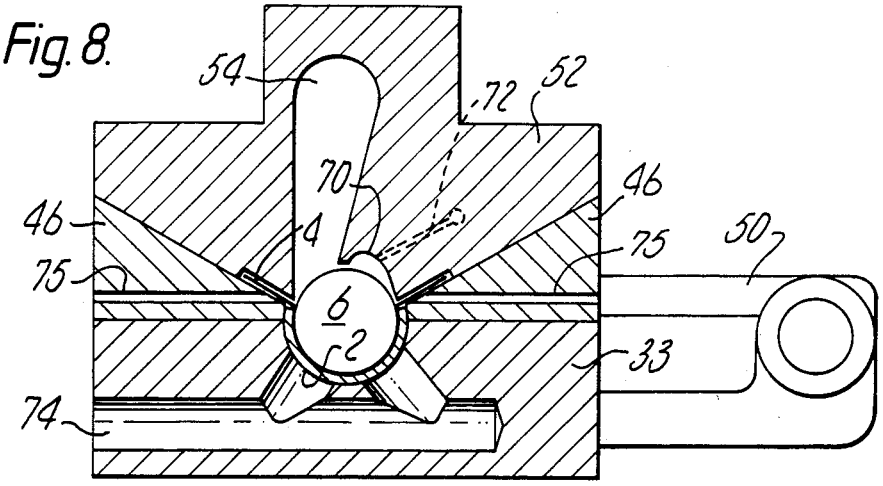

As shown in FIGS. 1 and 8, downstream of the position shown in FIG. 7 the upper guide unit 42 is replaced by a carbon granule filling head 52 which includes a channel 54 through which carbon granules are introduced into the spaces between filter portions 6. Referring also to FIG. 15, the channel 54 is inclined at a small angle to the line of the filter portions on the garniture tape 2. Carbon granules are delivered to the channel 54 from a hopper 58 by way of a funnel 60 to a rotor 62 having curved outwardly extending vanes 64. The funnel 60 includes a coarse screen 65 which may be vibrated to promote downward flow of the granules to the axis of the rotor 62. The screen 65 may comprise at least two parts relatively movable by means of a control unit 67 to vary and possibly interrupt flow of granules to the rotor 62. The vanes 64 of the rotor 62 deliver carbon granules to a duct 66 leading to the channel 54. The rotor 62 is driven at a speed such that carbon granules are delivered to the channel 54 having a velocity along the line of the garniture tape 2 which is approximately the same as that of the filter portions 6. This may be achieved by driving the rotor 62 (through a drive 71, FIG. 1) at a speed dependent on the speed of the garniture tape 2 (i.e. dependent on the speed of the rod-making machine).

The rate of delivery of granules from the hopper 58 to the rotor 62 is preferably the same as that required for filling the spaces between component filter portions 6. Consequently, no accumulation should occur in the duct 66 or channel 54 which would tend to reduce the speed of granules being delivered into the spaces between portions 6. In order to maintain a free flow path in the duct 66 and channel 54 a by-pass line including a by-pass duct 68 may be provided. As shown in FIG. 1 granules delivered into the by-pass duct 68 are eventually returned to the hopper 58 (by way of a return path 69). The proportion of granules passing from the rotor 62 which pass into the duct 68 rather than to the channel 54 may be adjusted, for example by applying variable suction to the duct 68, or by providing an adjustable divert gate 73 at the junction between the ducts 66 and 68. Control means 79 could be provided including means 77 to sense any accumulation of granules in the channel 54 and means to respond by varying the proportion of granules passing to the duct 68 (e.g. by moving the gate 73); alternatively the rate of delivery (e.g. the speed of the rotor 62 or the supply to the rotor 62) could be varied by the control means 79 (e.g. by varying the ratio of the drive 71 or by adjusting the screen 65 by way of the unit 67).

As already mentioned the channel 54 is inclined at a relatively small angle to the line of movement of the filter portions 6. In addition, it may be noted from FIG. 8 that the channel 54 delivers carbon granules to one side of this line; this has the effect of promoting a helical swirling motion of the carbon granules introduced into each space between component filter portions 6, which motion tends to reduce the kinetic energy of the introduced granules. The helical swirling motion is encouraged by a recess 70 provided in the filling head 52 adjacent the channel 54. Slight suction may be provided through a line indicated at 72 in FIG. 8 so that excess air introduced with the granules can be removed. Any granules removed with the air through the line 72 can be returned to the hopper 58 (e.g. by supply to the path 69).

Air may further be withdrawn from the spaces between component filter portions 6 through the wrapper 4 and garniture tape 2 (which are porous for this purpose) by means of suction channels 74 in the garniture bed 33. Thus a slight vacuum may be maintained in each space so that granules and entraining air are drawn into the spaces from the channel 54, most of the air subsequently being removed through the channels 74. Alternatively suction could be applied to the spaces between portions 6 through the opening between the edges of wrapper 4, substantially in accordance with the disclosure of British Patent Specification No. 1544116.

Further air lines 75 are provided in the lower guide unit 46 and may provide suction to maintain the free edges of the wrapper 4 on the guide surfaces of the unit 46 or, alternatively may provide a slight air flow to provide an air bearing effect for those edges (and possibly maintain them against guide surfaces of the filling head 52).

The filling head 52 may be lifted vertically way from the lower guide unit 46 to provide access to the filter portions 6 etc. to clear any blockages which might occur. Similarly, the lower guide unit 46 can be hinged away from the garniture bed 33 (and the upper guide unit 42 hinged away from the lower guide unit 46).

Figure 9:
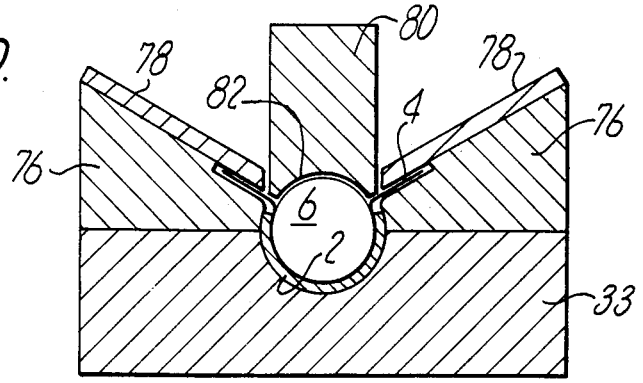
Figure 10:
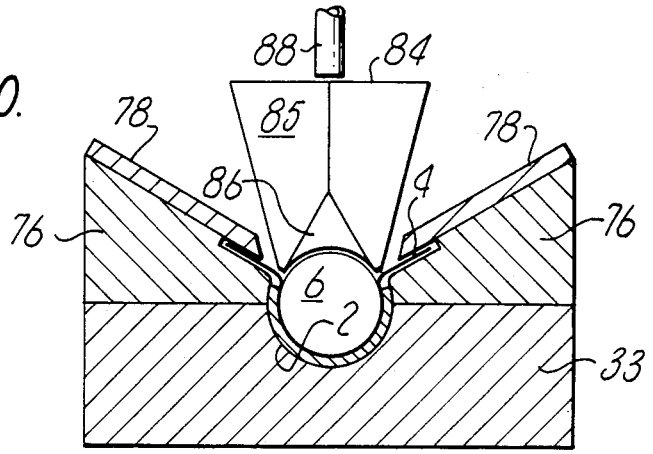
Figure 11:
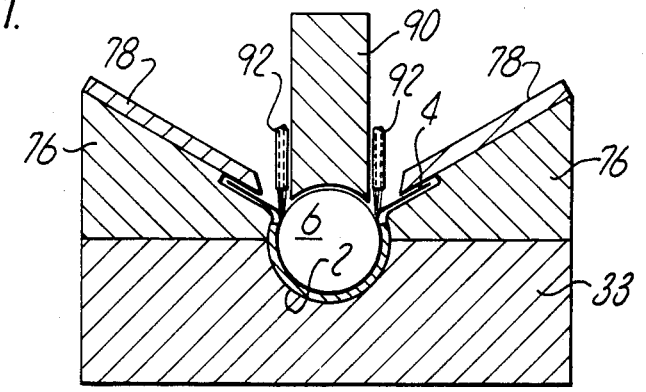

As shown in FIG. 9, downstream of the filling head 52 a guide unit 76 having plates 78 for maintaining the free edges of the wrapper 4 in place takes over from the lower guide unit 46. A fixed central cleaner 80 having a cleaning surface 82 which just clears the filter portions 6 is provided to remove any excess carbon granules introduced by the filling head 52. A further cleaning head 84 (FIG. 10) provided with a recess 85 (which is V-shaped in plan) over an inclined plough section 86 is located downstream of the cleaning head 80. Excess carbon granules are delivered upwards into the recess from where they may be removed by suction through a pipe 88 (FIG. 1). Only light suction is applied through the pipe 88, to effect removal of an accumulation of carbon granules in the recess 85 of the cleaning head 84; the suction is insufficient to withdraw any carbon granules directly from the spaces between filter portions 6. Beyond the cleaning head 84 is a further central shaping element 90 (FIG. 11) flanked by two narrow suction brushes 92 for removing carbon granules from the crevices formed between the wrapper 4 and the filter portions 6. Granules removed through the pipe 88 or brushes 92 may be returned to the hopper 58 by way of the path 69.

Figure 12:
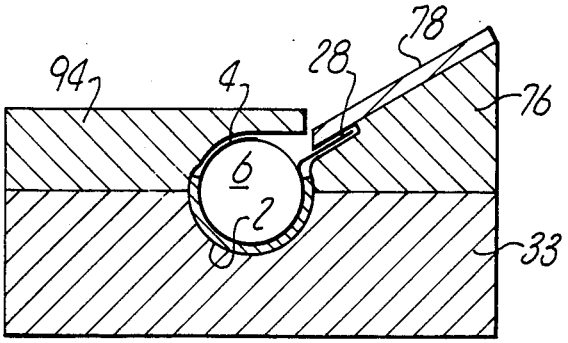

After the cleaning operations folding and sealing the wrapper 4 around the portions 6 and (filled spaces) takes place, as shown particularly in FIGS. 12, 13 and 14. A first holding unit 94 progressively folds over one free edge of the wrapper 4 onto the filter portions 6 and over the spaces containing carbon granules and, subsequently, a second folding unit 96 folds the second free edge of the wrapper 4 onto the first folded edge so that the adhesive line 28 overlaps the outer surface of the first edge. Subsequently a heating unit 98 contacts the seam formed by the overlapped wrapper edges and reactivates the adhesive of the line 28. The heating unit 98 is shortly followed by a cooling unit 100 (FIG. 1) which is substantially similar to the unit 98 except that it cools the adhesive to set it and seal the composite filter rod 12.

As shown in FIG. 1 the adhesive line 28 for forming the final seal of the rod 12 is applied upstream of the filling head 52. As an alternative this line could be applied after the filling head 52 and after operation of the cleaning devices 80–92, e.g. in the vicinity of the section shown in FIG. 12; this would have the advantage that possible contamination of the adhesive line by carbon granules would be avoided.

Part of a modified filling head including a filling channel 110 is shown in FIG. 16. Spaced component filter portions 112 and a wrapper 114 are conveyed by a garniture tape 116 on a garniture bed 118 and the garniture tape and wrapper are constrained to the shapes shown in FIG. 16 by folding units 120 and 122. It should be noted that the free edges of the wrapper 114 are not symmetrically disposed. Carbon granules are introduced into the spaces between portions 112 through the channel 110 with a velocity having an axial component substantially equal to that of the filter portions 112 and a significant tangential velocity which is dissipated by a helical swirling motion within the space between portions 112 in a manner similar to that described with reference to the filling head 52.

A further modified filling head comprising a filling duct 130, garniture bed 132 and side guides 134, 136 is shown in FIG. 17. The duct 130 has an extending skirt 138 which helps to prevent introduced carbon granules from escaping after introduction into the spaces between filter portions and also to define an upper surface shape for the introduced carbon granules. As with the previously-described arrangements the direction of introduction of granules also aids in preventing escape of granules by providing turbulence which removes kinetic energy.

I claim:

1. A method of producing composite filter rod, comprising conveying a stream of spaced component filter portions in an endwise direction, partially wrapping the portions in a continuous wrapper, and projecting particulate filter material with a certain velocity in a substantially continuous stream along a path which converges with that of said stream of filter portions, so that the spaces between said portions and partially enclosed by said wrapper receive particulate material directly from said path.

2. A method as claimed in claim 1, wherein said stream of particulate material is projected along said path so that its component velocity in the direction of said stream of spaced filter portions is substantially the same as that of said filter portions.

3. A method as claimed in claim 2, wherein said path and said stream of spaced filter portions are relatively disposed at a small angle.

4. A method as claimed in claim 1, wherein particulate material is introduced into each space with a circumferential component so that a rotary motion is imparted within the space by the partially surrounding wrapper.

5. A method as claimed in claim 1, wherein air is withdrawn from the space during or before it receives particulate material.

6. A method as claimed in claim 1, wherein several spaces between portions receive particulate material simultaneously.

7. A method as claimed in claim 1, wherein the rate of supply of particulate material on or onto said path is regulated.

8. A method of producing composite filter rod, comprising conveying a stream of spaced component filter portions in an endwise direction, partially wrapping the portions in a continuous wrapper, and conveying a substantially continuous stream of particulate filter material along a path which converges with that of said stream of filter portions, so that the spaces between said portions and enclosed by said wrapper receive particulate material direction from said path, including regulating the rate of supply of particulate material on or onto said path by diverting particulate material onto a subsidiary path.

9. Apparatus for producing composite filter rod, comprising means for conveying a stream of spaced component filter portions in an endwise direction, means for partially wrapping the stream in a continuous wrapper, and means for projecting particulate filter material with a certain velocity in a substantially continuous stream along a path which converges towards the stream of partially enclosed filter portions on the wrapper so that particulate filter material is introduced from said path onto said wrapper between said portions.

10. Apparatus as claimed in claim 9, including means for regulating the flow of particulate material on or onto said path.

11. Apparatus as claimed in claim 10, wherein said regulating means comprises means for varying the flow of particulate material between a supply of said material and said means for conveying material on said path.

12. Apparatus as claimed in claim 9, including a filling head in which said path terminates, said filling head extending along the direction of conveyance of the stream of filter portions such that at least two spaces between filter portions can receive particulate material simultaneously.

13. Apparatus as claimed in claim 12, wherein the filling head is shaped adjacent the end of said path to modify the flow path of particulate material introduced between the filter portions.

14. Apparatus as claimed in claim 13, wherein the filling head is shaped to redirect particulate material into the spaces between filter portions.

15. Apparatus as claimed in claim 9, including means for withdrawing air from the spaces between filter portions.

16. Apparatus as claimed in claim 9, including means to remove excess particulate material from the filter portions and wrapper.

17. Apparatus as claimed in claim 9, including conduit means defining said path and having wall means converging towards the stream of partially enclosed filter portions.

18. Apparatus for producing composite filter rod, comprising means for conveying a stream of spaced component filter portions in an endwise direction, means for partially wrapping the stream in a continuous wrapper, means for conveying particulate filter material in a substantially continuous stream on a path which converges towards the stream of partially enclosed filter portions on the wrapper so that particulate filter material is introduced from said path onto said wrapper between said portions, further including a movable screen provided with apertures corresponding with the spaces between filter portions in said stream and disposed between said path for particulate material and said spaces, whereby material is introduced into the spaces through said apertures and remaining parts of the screen prevent material contacting the sides of the filter portions.

19. Apparatus for producing composite filter rod, comprising means for conveying a stream of spaced component filter portions in an endwise direction, means for partially wrapping the stream in a continuous wrapper, means for conveying particulate filter material in a substantially continuous stream on a path which converges towards the stream of partially enclosed filter portions on the wrapper so that particulate filter material is introduced from said path onto said wrapper between said portions, wherein the means for conveying particulate material along said path comprises a rotary impeller.

20. Apparatus for producing composite filter rod, comprising means for conveying a stream of spaced component filter portions in an endwise direction, means for partially wrapping the stream in a continuous wrapper, means for conveying particulate filter material in a substantially continuous stream on a path which converges towards the stream of partially enclosed filter portions on the wrapper so that particulate filter material is introduced from said path onto said wrapper between said portions, wherein said path and said stream of spaced filter portions are slightly offset, so that the path terminates to one side of the center line of the filter portions and particulate material is directed from the end of said path predominantly to said one side.

21. Apparatus for producing composite filter rod, comprising means for conveying a stream of spaced component filter portions in an endwise direction, means for partially wrapping the stream in a continuous wrapper, means for conveying particulate filter material in a substantially continuous stream on a path which converges towards the stream of partially enclosed filter portions on the wrapper so that particulate filter material is introduced from said path onto said wrapper between said portions, including means for regulating the flow of particulate material on or onto said path, said regulating means including means for diverting material from said path.

22. Apparatus for producing composite filter rod, comprising means for conveying a stream of spaced component filter portions in an endwise direction, means for partially wrapping the stream in a continuous wrapper, means for conveying particulate filter material in a substantially continuous stream on a path which converges towards the stream of partially enclosed filter portions on the wrapper so that particulate filter material is introduced from said path onto said wrapper between said portions, including means for regulating the flow of particulate material on or onto said path and means for sensing flow on said path and for controlling said regulating means accordingly.

23. Apparatus for producing composite filter rod, comprising means for conveying a stream of spaced component filter portions in an endwise direction, means for partially wrapping the stream in a continuous wrapper, means for conveying particulate filter material in a substantially continuous stream on a path which converges towards the stream of partially enclosed filter portions on the wrapper so that particulate filter material is introduced from said path onto said wrapper between said portions, including means for regulating the flow of particulate material on or onto said path, the regulating means including means responsive to the speed of the stream of spaced filter portions.

24. A method of producing composite filter rod, comprising conveying a stream of spaced component filter portions in an endwise direction along a first path, partially wrapping the portions in a continuous wrapper on said first path, and conveying a substantially continuous stream of particulate material along a second path which converges towards said first path, so that the spaces between said portions and partially enclosed by said wrapper receive particulate material directly from said second path, said first and second paths being slightly off-set so that said second path terminates to one side of the center line of the filter portions on said first path and particulate material is directed from the end of said second path predominantly to said one side of said first path.

25. Apparatus for producing composite filter rod, comprising means for conveying a stream of spaced component filter portions in an endwise direction, means for partially wrapping the stream in a continuous wrapper, a container for particulate filter material, conduit means leading from said container and having wall means extending along a path converging towards the stream of partially enclosed filter portions on the wrapper, and means for conveying particulate filter material in a substantially continuous stream along said path so that particulate filter material is introduced from said path onto said wrapper between said portions.

26. Apparatus for producing composite filter rod, comprising means for conveying a stream of spaced component filter portions in an endwise direction, means for partially wrapping the stream in a continuous wrapper, means for conveying particulate filter material in a substantially continuous stream on a path which converges towards the stream of partially enclosed filter portions on the wrapper so that particulate filter material is introduced from said path onto said wrapper between said portions, including means to remove excess particulate material and means for returning said excess particulate material to said path.

* * * * *